US009862111B2

(12) United States Patent
Hsu

(10) Patent No.: US 9,862,111 B2
(45) Date of Patent: Jan. 9, 2018

(54) HAND ANTI-CUTTING STRUCTURE FOR CURTAIN CUTTING MACHINE

(71) Applicant: Sheen World Technology Corporation, Taichung (TW)

(72) Inventor: Hao-Yu Hsu, New Taipei (TW)

(73) Assignee: Sheen World Technology Corporation, Taichung (TW)

( * ) Notice: Subject to any disclaimer, the term of this patent is extended or adjusted under 35 U.S.C. 154(b) by 240 days.

(21) Appl. No.: 14/935,536

(22) Filed: Nov. 9, 2015

(65) Prior Publication Data

US 2017/0129118 A1 May 11, 2017

(51) Int. Cl.
*B26D 5/10* (2006.01)
*B26D 7/24* (2006.01)

(52) U.S. Cl.
CPC ..... *B26D 5/10* (2013.01); *B26D 7/24* (2013.01)

(58) Field of Classification Search
CPC .... B26D 5/10; B26D 7/22; B26D 7/24; Y10T 83/081; Y10T 83/404; Y10T 83/412; F16P 1/00; F16P 3/00
See application file for complete search history.

(56) References Cited

U.S. PATENT DOCUMENTS 6,178,857 B1 * 1/2001 Marocco ..... B23D 23/00 29/24.5
6,877,409 B2 * 4/2005 Huang ..... B23D 23/00 83/199
7,024,977 B2 * 4/2006 Nien ..... B23D 23/00 83/522.19
8,250,955 B2 * 8/2012 Sandberg ..... B26D 5/00 83/412
8,720,313 B2 * 5/2014 Kollman ..... B23D 23/00 83/196
9,068,393 B2 * 6/2015 Lee ..... E06B 9/66
9,586,332 B2 * 3/2017 Hsu ..... B26D 7/02
9,643,331 B2 * 5/2017 Hsu ..... B26D 7/01
2002/0178884 A1 * 12/2002 Chuang ..... B28D 5/0076 83/22
2003/0066403 A1 * 4/2003 Lin ..... B23D 23/00 83/412
2005/0150337 A1 * 7/2005 Cheng ..... B23D 17/08 82/101

(Continued)

*Primary Examiner* — Jason Daniel Prone
*Assistant Examiner* — Richard Crosby, Jr.
(74) *Attorney, Agent, or Firm* — Alan D. Kamrath; Kamrath IP Lawfirm, P.A.

(57) ABSTRACT

A hand anti-cutting structure for a curtain cutting machine contains a base, a cutting mechanism, and a security mechanism. The cutting mechanism includes a through orifice, an insertion segment, an extension segment, an inserting direction, and a cutter. The security mechanism includes a rail assembly, a sliding seat, a touch switch, and a stop member. The rail assembly has at least slidable rail parallel to the inserting direction, and the sliding seat has a movable actuation member and an operation member. The touch switch is secured on a moving path of the actuation member, and when the actuation member moves to abut against the touch switch, the touch switch is turned on by the actuation member. The stop member is connected with and driven by the actuation member, wherein the stop member is located on the insertion segment and is perpendicular to the inserting direction of the cutting mechanism.

8 Claims, 11 Drawing Sheets

(56) References Cited

U.S. PATENT DOCUMENTS

| | | | | |
|---|---|---|---|---|
| 2005/0150344 | A1* | 7/2005 | Nien | B26D 5/08 83/651 |
| 2006/0156882 | A1* | 7/2006 | Kollman | B23D 23/00 83/167 |
| 2012/0090439 | A1* | 4/2012 | Butler | B23D 59/006 83/68 |
| 2017/0129118 | A1* | 5/2017 | Hsu | B26D 7/24 |

* cited by examiner

HAND ANTI-CUTTING STRUCTURE FOR CURTAIN CUTTING MACHINE

BACKGROUND OF THE INVENTION

Field of the Invention

The present invention relates to a curtain cutting machine, and more particularly to a hand anti-cutting structure for a curtain cutting machine which operates the curtain cutting machine by using user's two hands so as to cut a curtain safely.

Description of the Prior Art

A conventional curtain is employed to shield or decorate a window in a building, wherein a blind curtain is most popular and contains a first rail, a second rail, and plural blinds. As producing the blind curtain in various sizes (i.e., widths of the first rail, the second rail, and the plural blinds are different to form widths of a plurality of blind curtains), hence a curtain cutting machine cuts and trims a variety of curtains at desired widths for decoration and light shielding effect.

The curtain is comprised of a first rail, a second rail, and plural blinds which are elongated. To cut the plural blinds of the curtain flatly, the plural blinds are moved close to one another. In case the plural blinds are not moved close to one another, they will be cut roughly to cause different lengths and uneven rims. Furthermore, a control rope is inserted among the first rail, the second rail, and the plural blinds to separate the first rail, the second rail, and the plural blinds at a limited distance. As cutting the conventional curtain, a positioning block is fixed among the plural blinds to move the plural blinds close to one another. However, fixing the positioning block among the plural blinds is troublesome and time-consuming at a high labor cost. Moreover, the plural blinds are damaged as being cut roughly.

The present invention has arisen to mitigate and/or obviate the afore-described disadvantages.

SUMMARY OF THE INVENTION

The primary objective of the present invention is to provide a hand anti-cutting structure for a curtain cutting machine in which a cutting mechanism is started by user's one end and an operation member is held by user's other hand to control an actuation member, such that an actuation member moves to abut against and to start a touch switch, thus cutting a curtain by two hands, hence when a user removes cut scraps or conducts other operations, he/she will not be cut by a cutter after touching the touch switch unintentionally, thus enhancing using safety.

Another objective of the present invention is to provide a hand anti-cutting structure for a curtain cutting machine in which a stop member is connected with and driven by the actuation member of a sliding seat, so when cutting the curtain, the stop member removes from the curtain with the operation member to reduce a block of the cut scraps of the curtain at a cutting position of the curtain cutting machine and to enhance using convenience.

Accordingly, a hand anti-cutting structure for a curtain cutting machine provided by the present invention contains: a base, a cutting mechanism, and a security mechanism.

The base is an elongated platform.

The cutting mechanism is mounted on the base and includes a through orifice for inserting the curtain, an insertion segment, an extension segment, an inserting direction parallel to the through orifice, and a cutter disposed on the insertion segment.

The security mechanism corresponds to the cutting mechanism and includes a rail assembly, a sliding seat, a touch switch, and a stop member. The rail assembly has at least slidable rail parallel to the inserting direction of the cutting mechanism, the sliding seat is movably fixed on the at least one slidable rail and has a movable actuation member secured on one side thereof, and the sliding seat has an operation member disposed thereon so as to control the actuation member to move, the touch switch is secured on a moving path of the actuation member of the sliding seat.

The touch switch is turned off in a normal state, and when the actuation member moves to abut against the touch switch, the touch switch is turned on by the actuation member, the stop member is connected with and driven by the actuation member of the sliding seat, and the stop member is connected with and is driven by the actuation member of the sliding seat, wherein the stop member is located on one side of the insertion segment and is perpendicular to the inserting direction of the cutting mechanism.

DETAILED DESCRIPTION OF THE PREFERRED EMBODIMENTS

Figure 1:
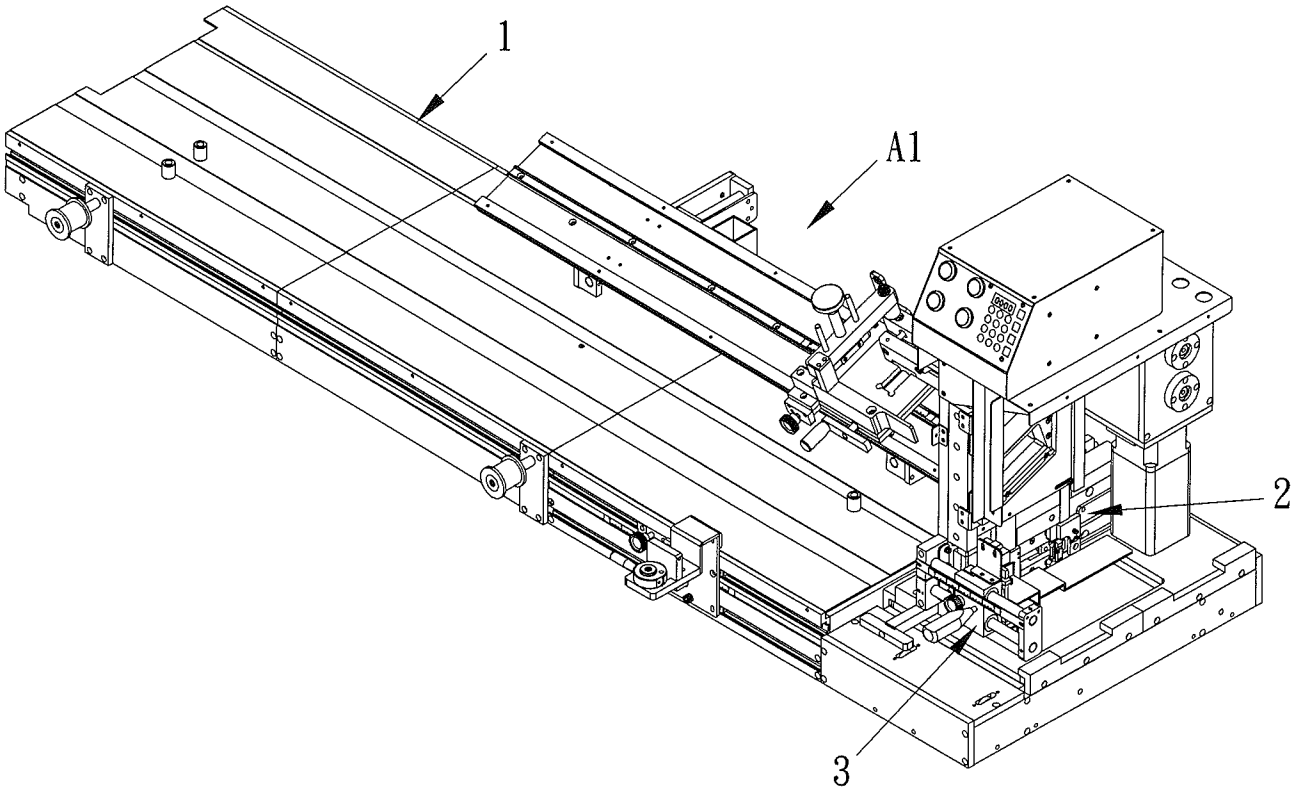
FIG. 1 is a perspective view showing the assembly of a curtain cutting machine in accordance with a preferred embodiment of the present invention.
Figure 2:
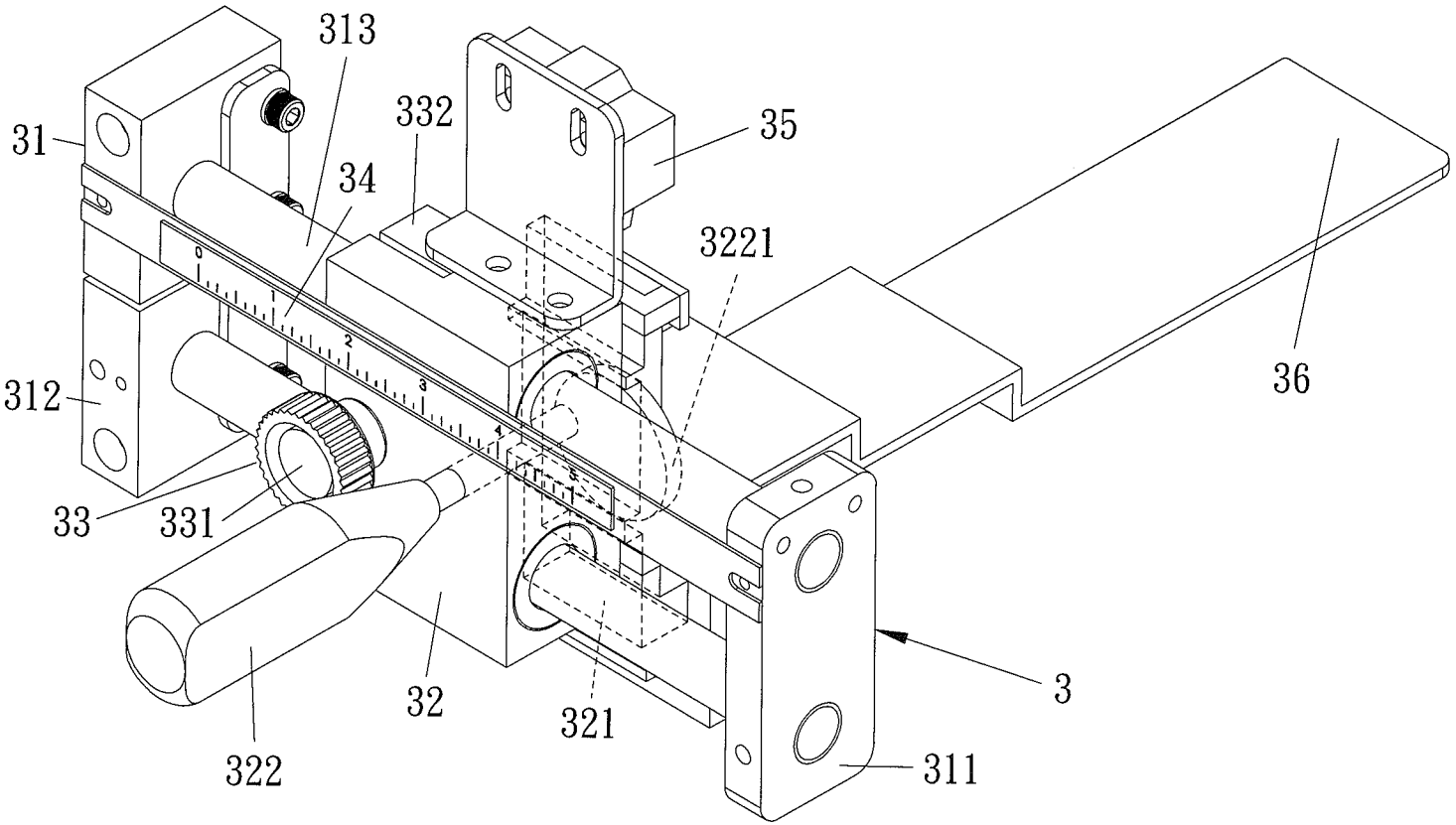
FIG. 2 is a perspective view showing the assembly of a security mechanism of the curtain cutting machine in accordance with the preferred embodiment of the present invention.
Figure 3:
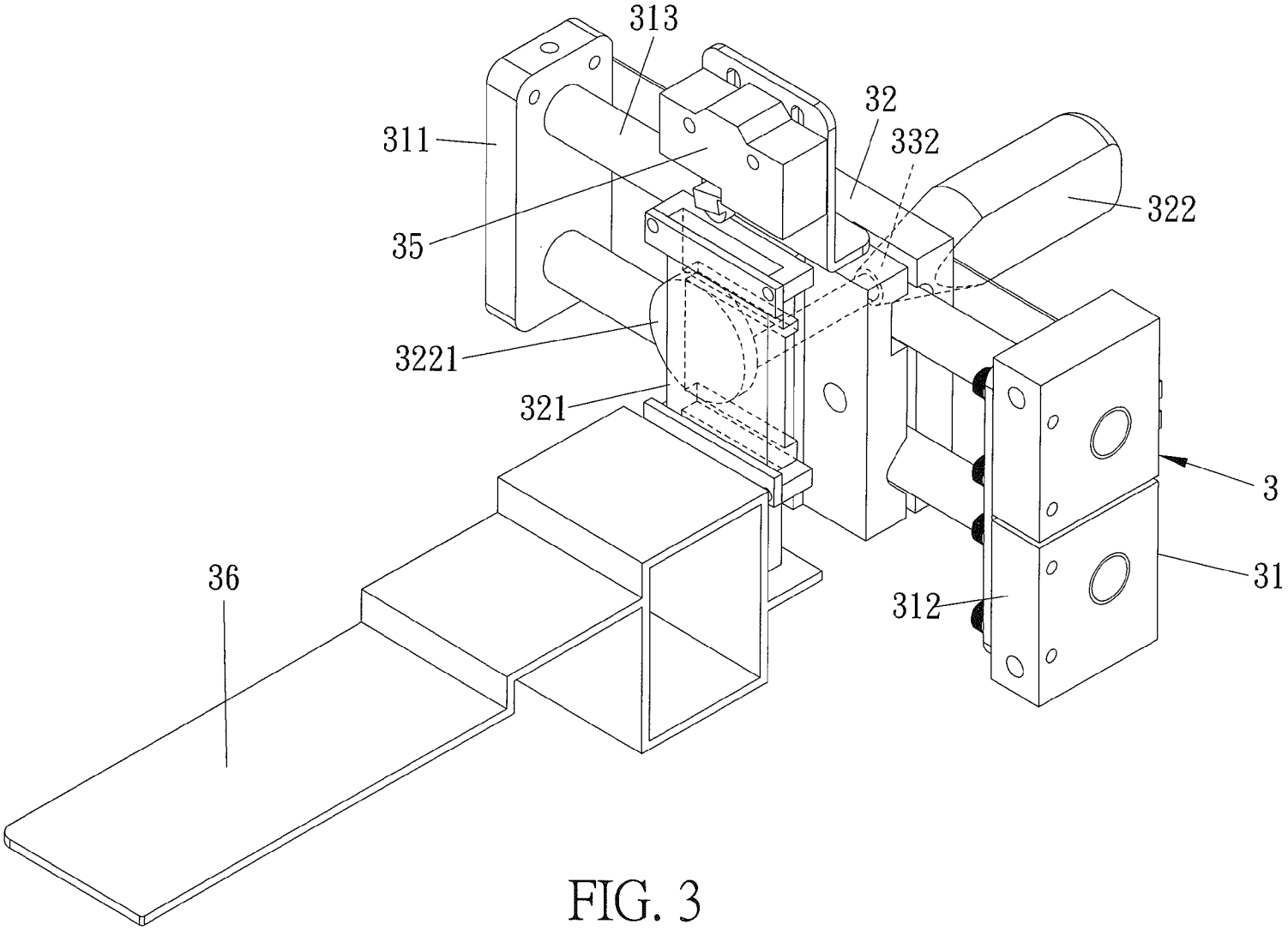
FIG. 3 is another perspective view showing the assembly of the security mechanism of the curtain cutting machine in accordance with the preferred embodiment of the present invention.

The present invention will be clearer from the following description when viewed together with the accompanying drawings, which show, for purpose of illustrations only, the preferred embodiment in accordance with the present invention.

With reference to FIGS. 1 to 4 and 7, a hand anti-cutting structure for a curtain cutting machine according to a preferred embodiment of the present invention, wherein a curtain cutting machine A1 is adapted to cut a curtain A2 and comprises: a base 1, a cutting mechanism 2, and an security mechanism 3, wherein the base 1 is an elongated platform, and the cutting mechanism 2 is mounted on the base 1. The cutting mechanism 2 includes a through orifice 21 for inserting a curtain, an insertion segment 22, an extension segment 23, an inserting direction 24 parallel to the through orifice 21, and a cutter 25 disposed on the insertion segment 22. The security mechanism 3 corresponds to the cutting mechanism 2 and includes a rail assembly 31, a sliding seat 32, a positioning unit 33, a scale ruler 34, a touch switch 35, and a stop member 36. The rail assembly 31 has a first fixing mount 311, a second fixing mount 312, and at least slidable rail 313 arranged between the first fixing mount 311 and the second fixing mount 312. In this embodiment, two slidable rails 313 are arranged between the first fixing mount 311 and the second fixing mount 312, and the two slidable rails 313 are parallel to the inserting direction 24 of the cutting mechanism 2. The sliding seat 32 is movably fixed on the two slidable rails 313 and has a movable actuation member 321 secured on one side thereof and has an operation member 322 disposed thereon so as to control the actuation member 321 to move and to drive the sliding seat 32 to slide on the two slidable rails 313. In this embodiment, the operation member 322 controls the actuation member 321 to move in a rotatable pushing manner. The operation member 322 of the sliding seat 32 has a distal end connecting with a push element 3221, hence the operation member 322 rotatably pushes the push element 3221 to rotate simultaneously, and the actuation member 321 is driven by the push element 3221 to move. The positioning unit 33 is mounted on the sliding seat 32 and has a screw bolt 331 and a clamping element 332, wherein the screw bolt 331 screws with the clamping element 332 through the sliding seat 32 and rotates to drive the clamping element 332 to move based on using requirements, such that the clamping element 332 cooperates with the sliding seat 32 to clamp or release the two slidable rails 313, thus locking or unlocking the sliding seat 32. The scale ruler 34 is fixed between the first fixing mount 311 and the second fixing mount 312 and is parallel to the two slidable rails 313 so as to correspond to the sliding seat 32. The touch switch 35 is secured on a moving path of the actuation member 321 of the sliding seat 32, wherein the touch switch 35 is turned off in a normal state, and when the actuation member 321 moves to abut against the touch switch 35, the touch switch 35 is turned on by the actuation member 321. The stop member 36 is connected with and driven by the actuation member 321 of the sliding seat 32 and is located on one side of the insertion segment 23, and the stop member 36 is perpendicular to the inserting direction 24 of the cutting mechanism 2.

Figure 4:
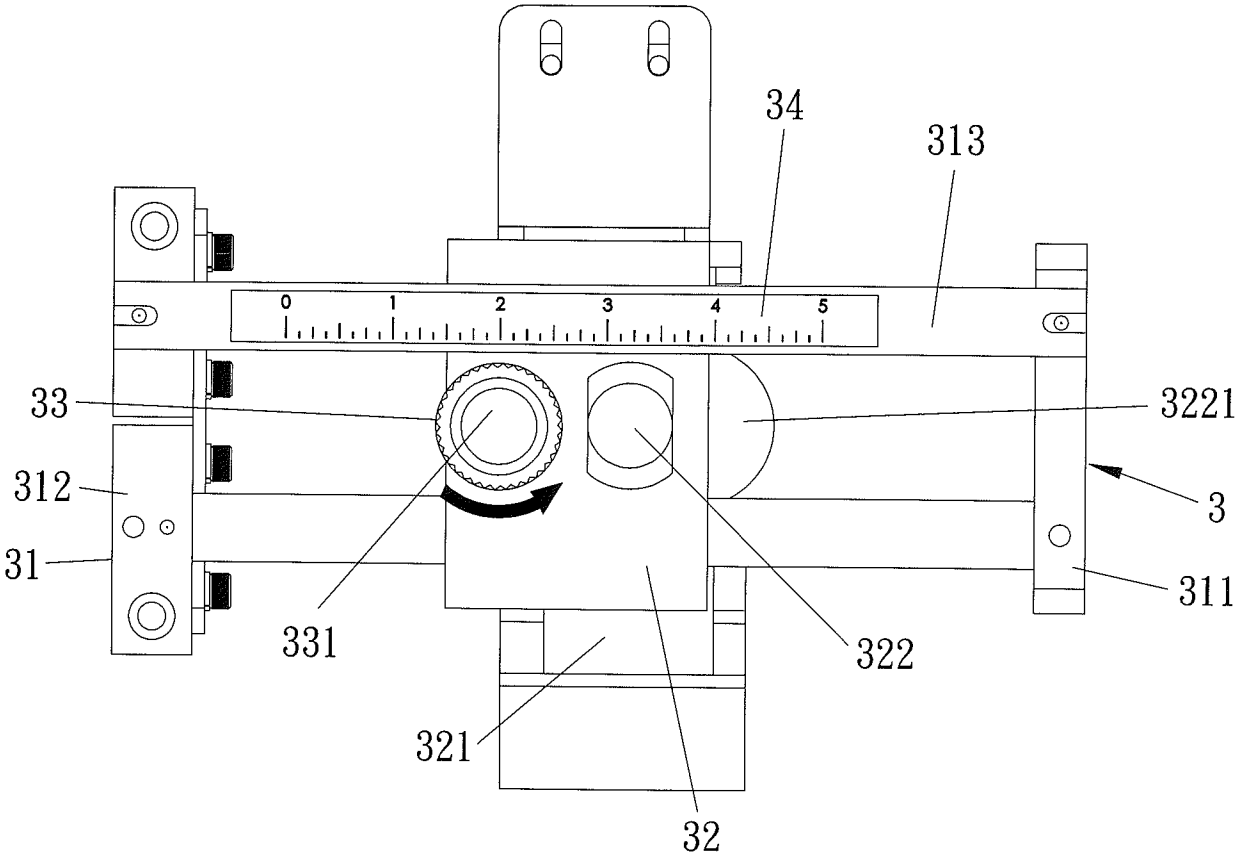
FIG. 4 is a side plane view showing the operation of a positioning mechanism of the curtain cutting machine in accordance with the preferred embodiment of the present invention.
Figure 5:
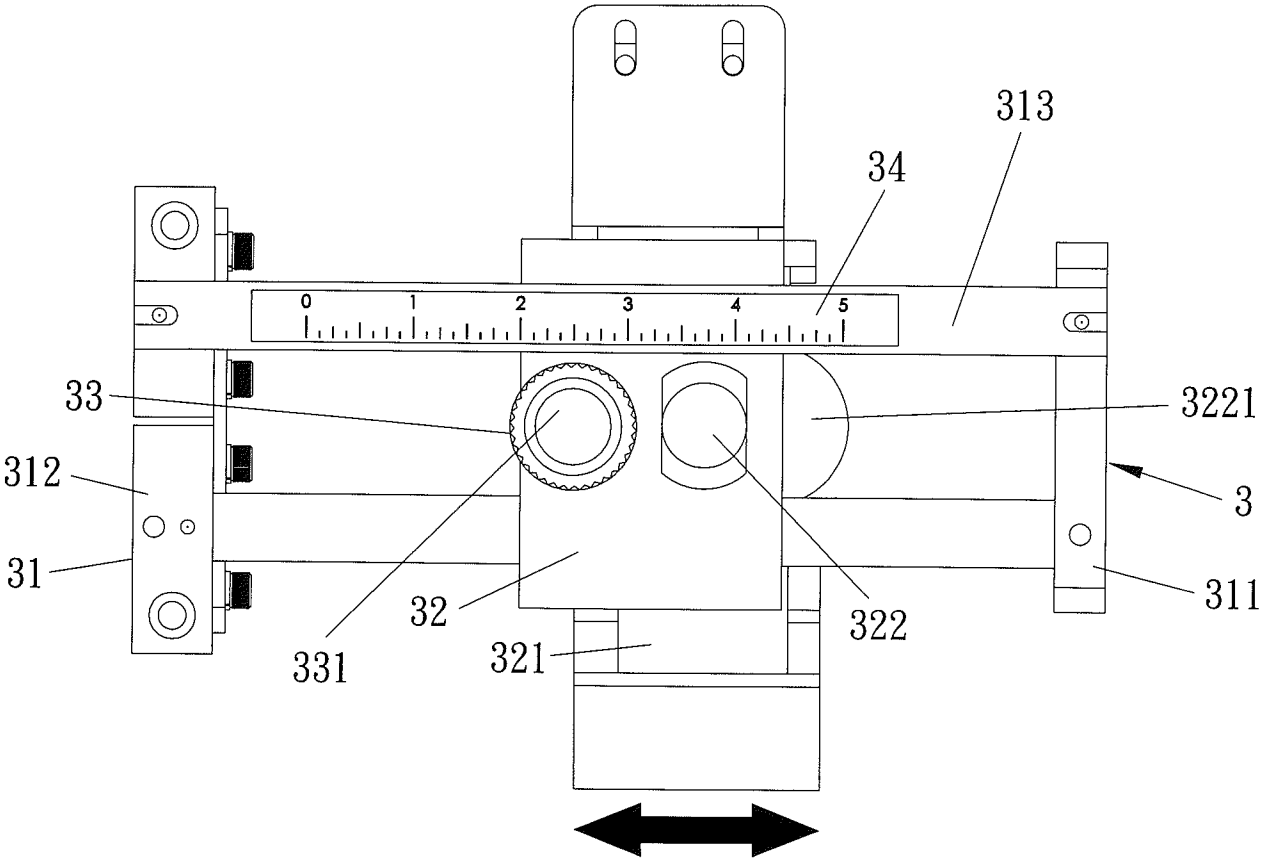
FIG. 5 is a side plane view showing the operation of a sliding seat of the curtain cutting machine in accordance with the preferred embodiment of the present invention
Figure 6:
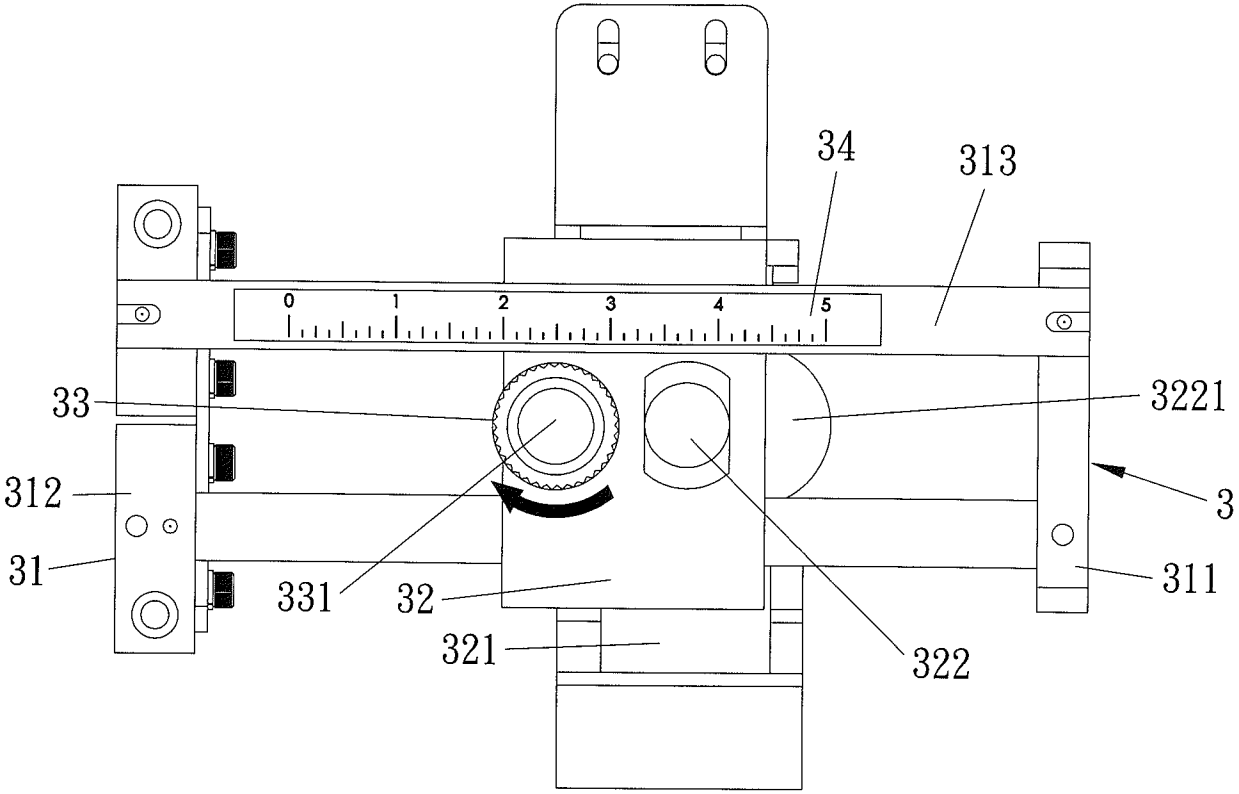
FIG. 6 is another side plane view showing the operation of the positioning mechanism of the curtain cutting machine in accordance with the preferred embodiment of the present invention
Figure 7:
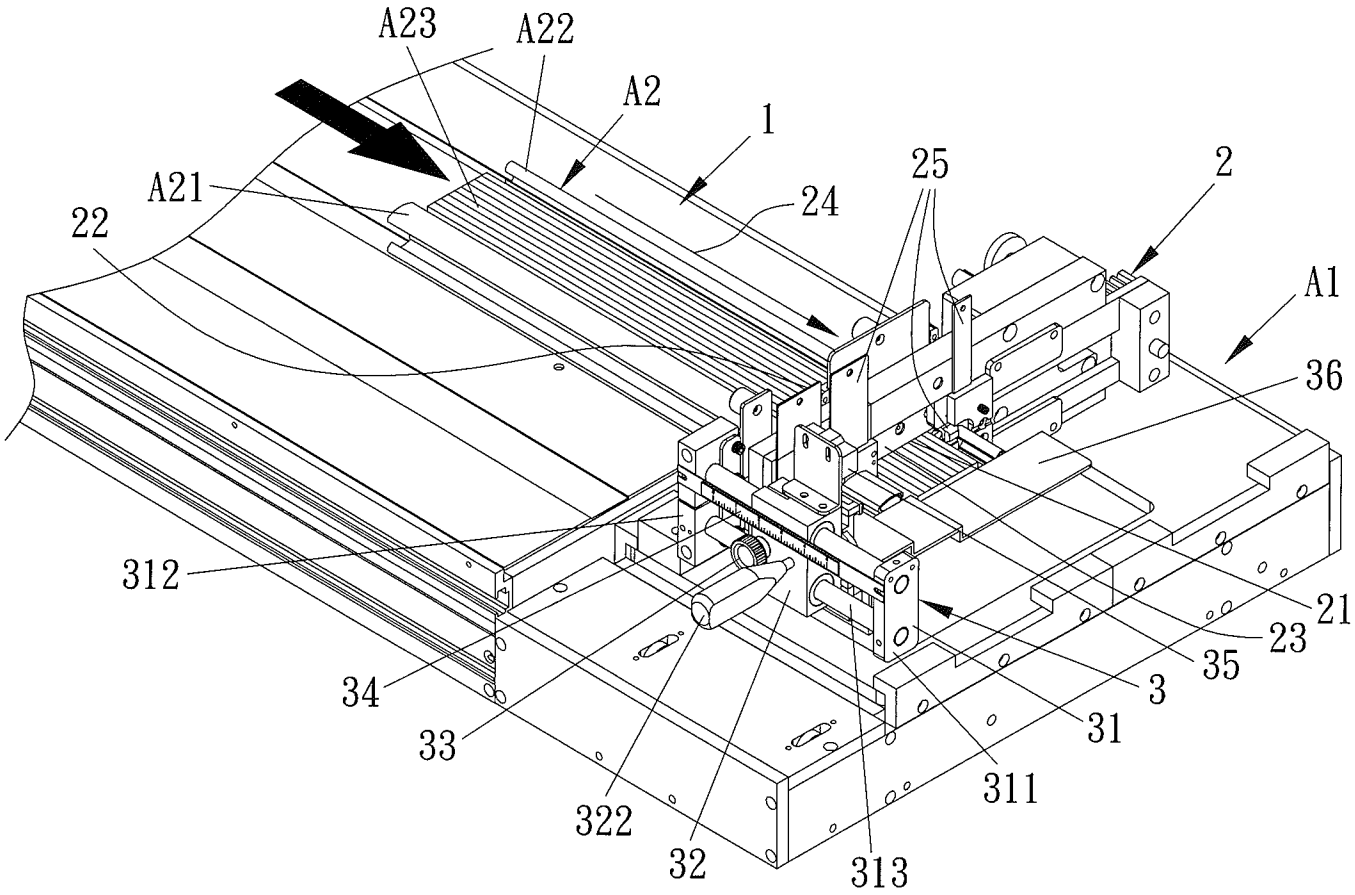
FIG. 7 is a perspective view showing a curtain being inserted through a through orifice and being stopped by a stop member in accordance with the preferred embodiment of the present invention.
Figure 8:
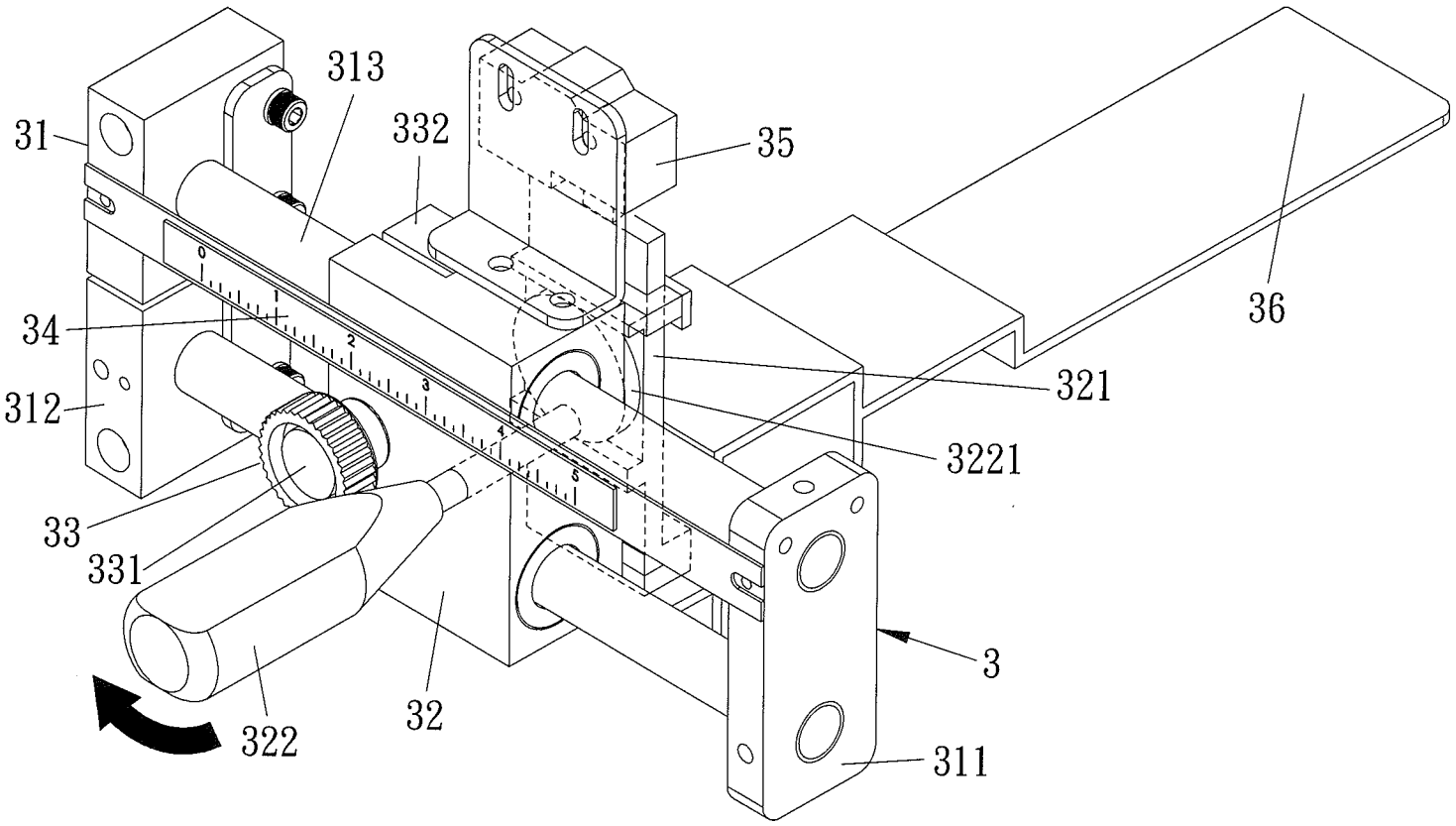
FIG. 8 is a perspective view showing an operation member of the curtain cutting machine controlling an actuation member to abut against and to start a touch switch in accordance with the preferred embodiment of the present invention.
Figure 9:
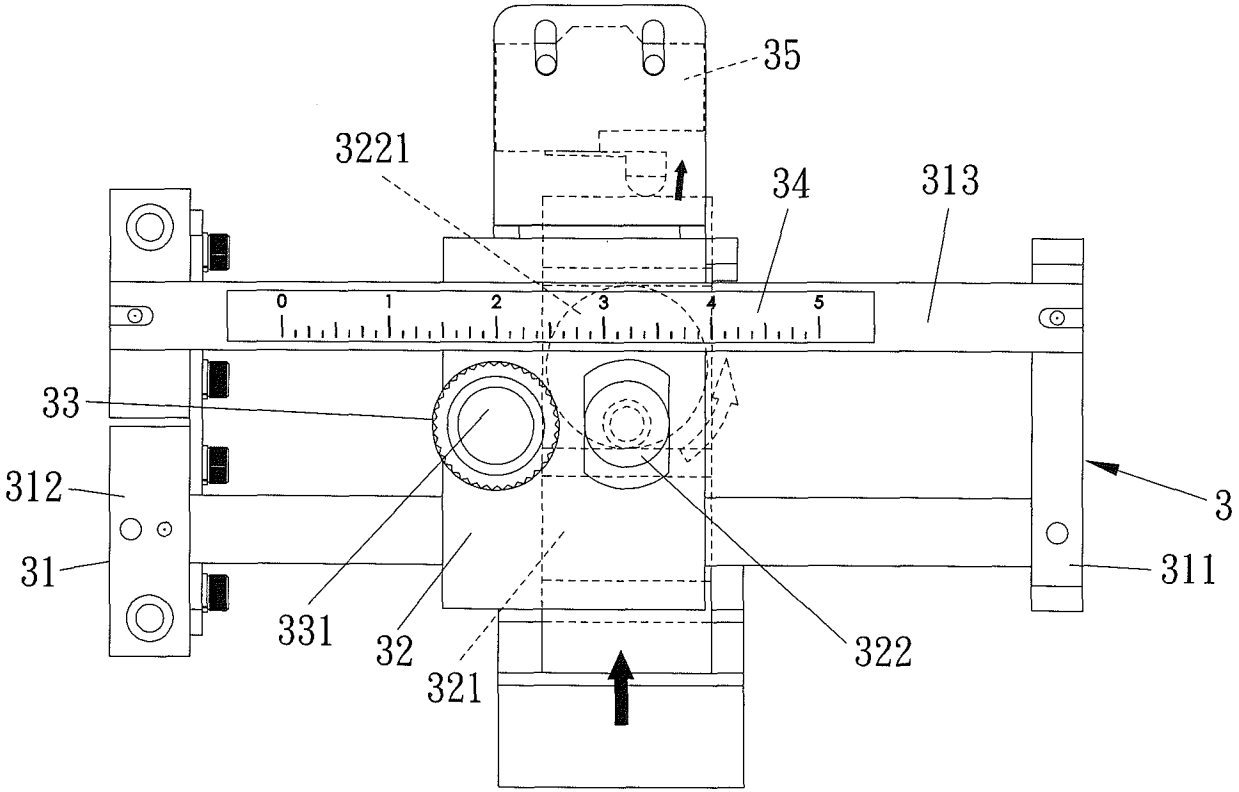
FIG. 9 is a side plane view showing the operation member of the curtain cutting machine controlling the actuation member to abut against and to start the touch switch in accordance with the preferred embodiment of the present invention.
Figure 10:
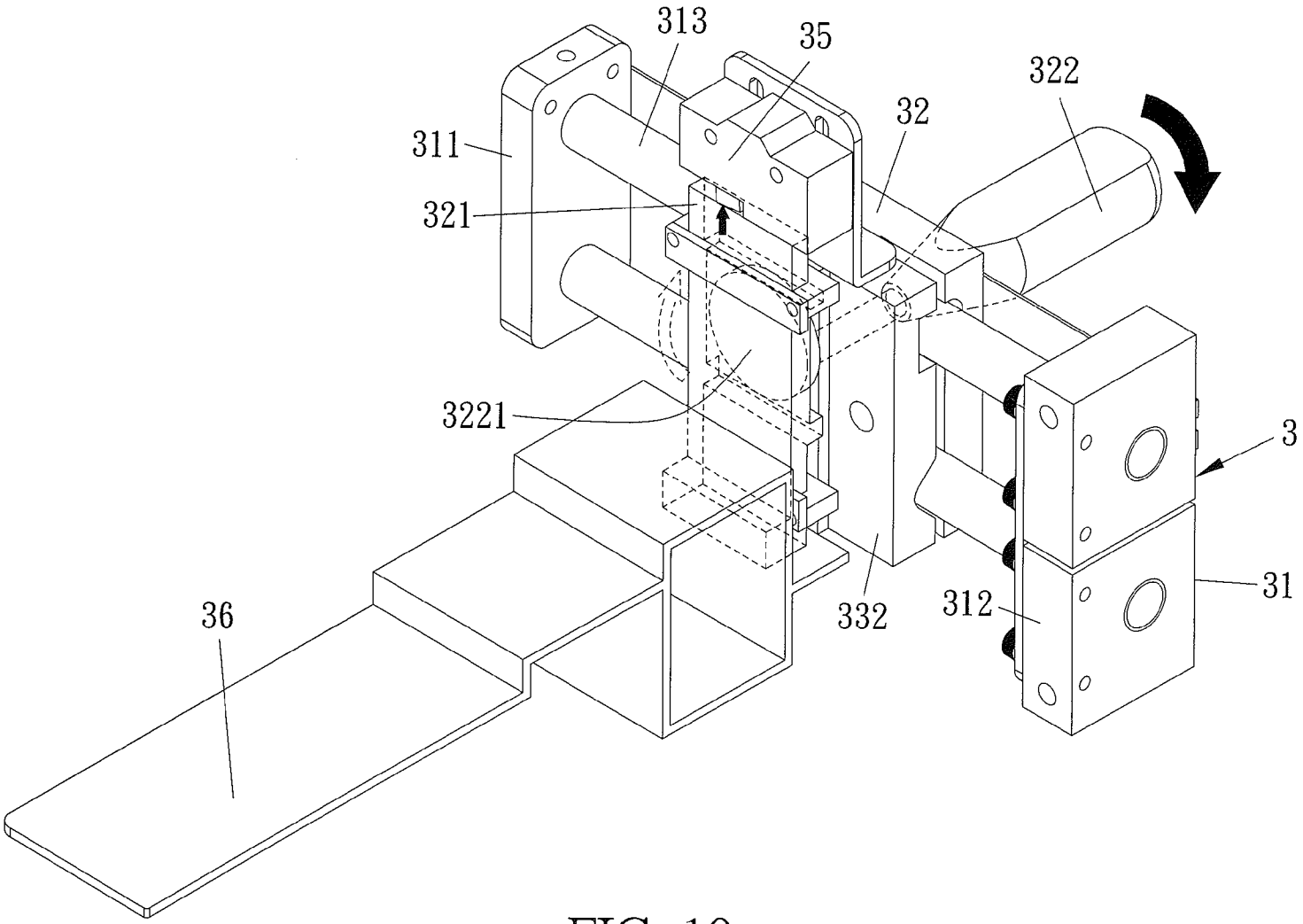
FIG. 10 is another perspective view showing the operation member of the curtain cutting machine controlling the actuation member to abut against and to start the touch switch in accordance with the preferred embodiment of the present invention.
Figure 11:
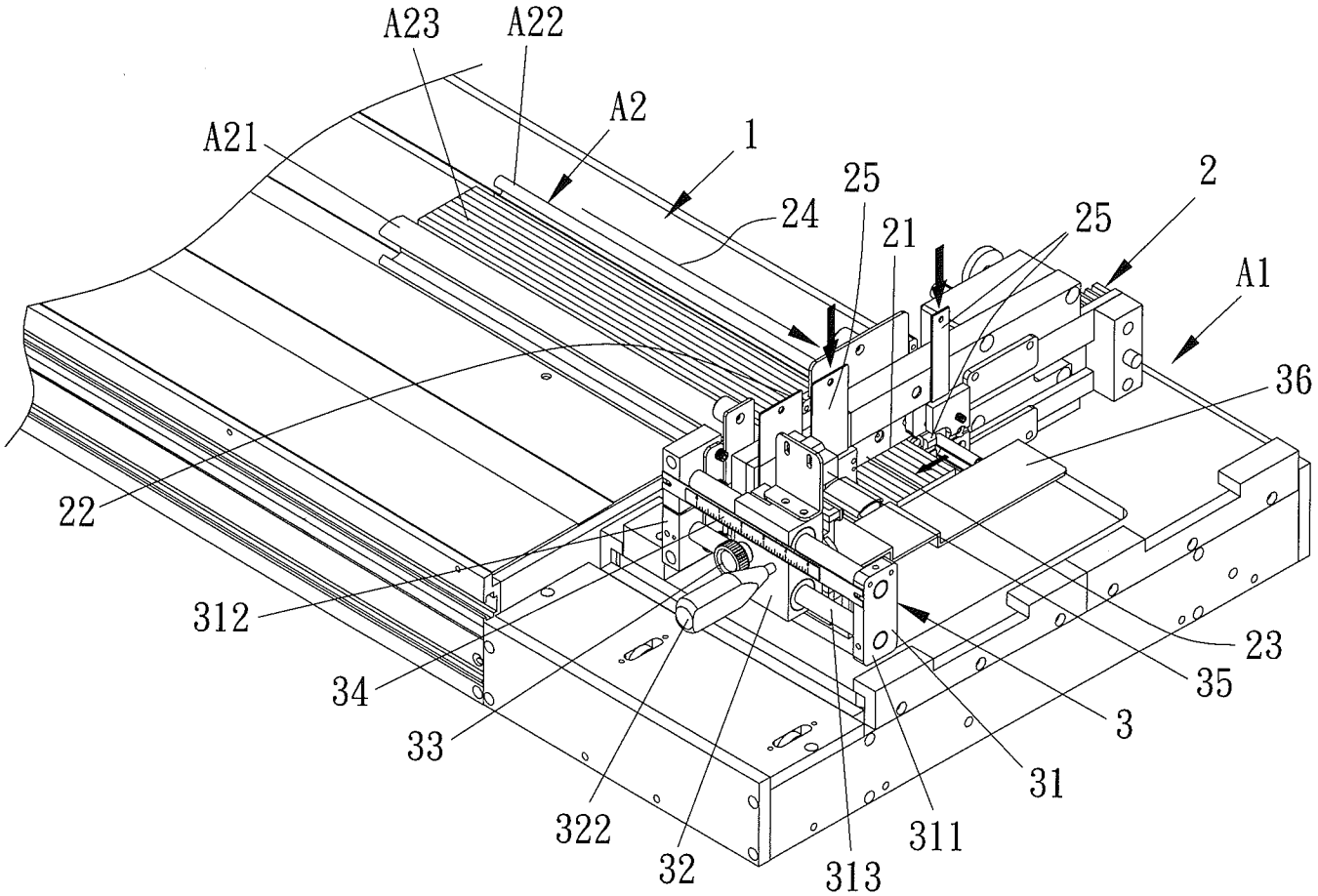
FIG. 11 is a perspective view showing the operation of the curtain cutting machine in accordance with the preferred embodiment of the present invention.

When cutting the curtain, as shown in FIG. 4, the screw bolt 331 of the positioning unit 33 is released so that the clamping element 332 release the two slidable rails 313 by which the sliding seat 32 is unlocked. Referring further to FIG. 5, the operation member 322 of the sliding seat 32 drives the sliding seat 32 and the positioning unit 33 to slide on the two slidable rails 313 and is adjusted toward a predetermined position by corresponding to the scale ruler 34, as illustrated in FIG. 6, the screw bolt 331 of the positioning unit 33 is rotated tightly so that the clamping element 332 cooperates with the sliding seat 32 to clamp the two slidable rails 313, thus locking the sliding seat 32. With reference to FIGS. 7 to 11, a first rail A21, a second rail A22, and a curtain blind A23 of the curtain A2 are inserted through the through orifice 21 of the cutting mechanism 2 along the inserting direction 24 so that a part of a first end of the curtain A2 extends out of the through orifice 21 and is sopped by the stop member 36, thus clamping the curtain A2. Thereafter, the cutting mechanism 2 is started by one hand and the operation member 322 is held by the other hand to control the actuation member 321, such that the actuation member 321 moves to abut against and to start the touch switch 35, thus cutting the curtain A2. The operation member 322 is released after the curtain A2 is cut, and the operation member 322 and the actuation member 321 automatically move back to their original positions themselves and other auxiliary components so that the actuation member 321 removes from the touch switch 35, hence the touch switch 35 is turned off to avoid the cutter 25 being started by the touch switch 35 to cut user's hands.

When a second end of the curtain A2 or another curtain A2 are cut in a same length, the sliding seat 32 is locked, and the second end of the curtain A2 or a first rail A21, a second rail A22, and a curtain blind A23 of one end of said another curtain A2 are inserted through the through orifice 21 of the cutting mechanism 2 along the inserting direction 24 so that a part of the second end of the curtain A2 extends out of the through orifice 21 to be stopped by the stop member 36, the curtain A2 is clamped, and the cutting mechanism 2 is started by the one end, and the operation member 322 is held by the other hand to control the actuation member 321, such that the actuation member 321 moves to abut against and to start the touch switch 35, thus cutting the curtain A2 in the same length.

The hand anti-cutting structure of the present invention contains advantages as follows:

1. The cutting mechanism 2 is started by user's one hand and the operation member 322 is held by user's other hand to control the actuation member 321, such that the actuation member 321 moves to abut against and to start the touch switch 35, thus cutting the curtain A2 by two hands. Thereby, when a user removes cut scraps or conducts other operations, he/she will not be cut by the cutter 25 after touching the touch switch unintentionally, thus enhancing using safety.

2. The stop member 36 is connected with and driven by the actuation member 321 of the sliding seat 32, so when cutting the curtain A2, the stop member 36 removes from the curtain A2 with the operation member 322 to reduce a block of the cut scraps of the curtain A2 at a cutting position of the curtain cutting machine and to enhance using convenience.

While we have shown and described various embodiments in accordance with the present invention, it is clear to those skilled in the art that further embodiments may be made without departing from the scope of the present invention.

What is claimed is:

1. A hand anti-cutting structure for a curtain cutting machine, a curtain cutting machine being adapted to cut a curtain and comprising:

a base being an elongated platform;

a cutting mechanism mounted on the base and including a through orifice for inserting the curtain, an insertion segment, an extension segment, an inserting direction parallel to the through orifice, and a cutter disposed on the insertion segment;

a security mechanism corresponds to the cutting mechanism and including a rail assembly, a sliding seat, a touch switch, and a stop member, the rail assembly having at least one slidable rail parallel to the inserting direction of the cutting mechanism, the sliding seat being movably fixed on the at least one slidable rail and having a movable actuation member secured on one side thereof, and the sliding seat having an operation member disposed thereon so as to control the actuation member to move, the touch switch being secured on a moving path of the actuation member of the sliding seat, wherein the touch switch is turned off in a normal state, and when the actuation member moves to abut against the touch switch, the touch switch is turned on by the actuation member, the stop member is connected with and driven by the actuation member of the sliding seat, and the stop member is connected with and is driven by the actuation member of the sliding seat, wherein the stop member is located on one side of the insertion segment and is perpendicular to the inserting direction of the cutting mechanism.

2. The hand anti-cutting structure for the curtain cutting machine as claimed in claim 1, wherein the security mechanism further has a positioning unit mounted on the sliding seat to lock or unlock the sliding seat.

3. The hand anti-cutting structure for the curtain cutting machine as claimed in claim 2, wherein the positioning unit has a screw bolt and a clamping element, and the screw bolt screws with the clamping element through the sliding seat and rotates to drive the clamping element to move, such that the clamping element cooperates with the sliding seat to lock or unlock the sliding seat.

4. The hand anti-cutting structure for the curtain cutting machine as claimed in claim 1, wherein the security mechanism further has a scale ruler fixed on the rail assembly to indicate a position of the sliding seat.

5. The hand anti-cutting structure for the curtain cutting machine as claimed in claim 4, wherein the scale ruler is parallel to the rail assembly.

6. The hand anti-cutting structure for the curtain cutting machine as claimed in claim 1, wherein the operation member has a distal end connecting with a push element, the operation member rotatably pushes the push element to rotate simultaneously, and the actuation member is driven by the push element to move.

7. The hand anti-cutting structure for the curtain cutting machine as claimed in claim 1, wherein the rail assembly has a first fixing mount, a second fixing mount, and the at least slidable rail arranged between the first fixing mount and the second fixing mount.

8. The hand anti-cutting structure for the curtain cutting machine as claimed in claim 1, wherein the operation member of the sliding seat drives the sliding seat to move on the at least one slidable rail.

* * * * *